US010269201B2

(12) United States Patent
Kim et al.

(10) Patent No.: US 10,269,201 B2
(45) Date of Patent: Apr. 23, 2019

(54) MEDIUM PROCESSING APPARATUS WITH REJECT CASSETTE

(71) Applicant: NAUTILUS HYOSUNG INC., Seoul (KR)

(72) Inventors: Jun Young Kim, Gyeonggi-do (KR); Jong Seong Park, Gyeonggi-do (KR); Soon Ho Choi, Gyeonggi-do (KR)

(73) Assignee: NAUTILUS HYOSUNG INC., Seoul (KR)

( * ) Notice: Subject to any disclaimer, the term of this patent is extended or adjusted under 35 U.S.C. 154(b) by 161 days.

(21) Appl. No.: 15/381,186

(22) Filed: Dec. 16, 2016

(65) Prior Publication Data

US 2017/0193731 A1 Jul. 6, 2017

(30) Foreign Application Priority Data

Dec. 30, 2015 (KR) ..... 10-2015-0190316

(51) Int. Cl.
*G07D 7/20* (2016.01)
*G07D 11/00* (2019.01)
(Continued)

(52) U.S. Cl.
CPC ..... *G07D 11/0033* (2013.01); *B65H 1/28* (2013.01); *B65H 29/16* (2013.01); *B65H 31/22* (2013.01); *B65H 43/04* (2013.01); *G07D 7/20* (2013.01); *G07D 11/006* (2013.01); *G07D 11/0027* (2013.01); *G07D 11/0039* (2013.01);
(Continued)

(58) Field of Classification Search
CPC .. G07D 11/0033; G07D 7/20; G07D 11/0027; G07D 11/0039; G07D 11/0054; G07F 19/20; B65H 31/22; B65H 29/16; B65H 43/04; B65H 1/28
See application file for complete search history.

(56) References Cited

U.S. PATENT DOCUMENTS 6,012,564 A * 1/2000 Mukai ..... G07D 11/0036 194/206
6,015,147 A * 1/2000 Kimura ..... G07D 11/0003 209/534
(Continued)

FOREIGN PATENT DOCUMENTS

JP 2013-117898 A 6/2013
KR 10-2015-0059188 A 6/2015

*Primary Examiner* — Patrick H Mackey
(74) *Attorney, Agent, or Firm* — Bacon & Thomas, PLLC

(57) ABSTRACT

A medium processing apparatus includes a receiving and dispensing port, a discriminating unit, a temporary storage, a reject cassette in which an abnormal medium temporarily stored in the temporary storage and a carried abnormal medium among media being withdrawn are collected and stored, a plurality of recycling cassettes configured to store media to be withdrawn, a first driving unit configured to drive a carrying path between an outlet of the discriminating unit and each of the receiving and dispensing port and the temporary storage, a second driving unit configured to drive a carrying path between an inlet of the discriminating unit and an inlet of the reject cassette and be a belt-roller type, and a third driving unit configured to drive a carrying path between the inlet of the reject cassette and each of inlets of the plurality of recycling cassettes and be a belt-guide type.

8 Claims, 8 Drawing Sheets

(51) Int. Cl.

| | |
|---|---|
| ***B65H 1/28*** | (2006.01) |
| ***B65H 29/16*** | (2006.01) |
| ***B65H 31/22*** | (2006.01) |
| ***B65H 43/04*** | (2006.01) |
| ***G07F 19/00*** | (2006.01) |

(52) U.S. Cl.
CPC ..... *G07D 11/0054* (2013.01); *G07F 19/20* (2013.01); *B65H 2211/00* (2013.01); *B65H 2701/1912* (2013.01); *G07D 11/0084* (2013.01)

(56) References Cited

U.S. PATENT DOCUMENTS

| | | | | |
|---|---|---|---|---|
| 2011/0130870 | A1* | 6/2011 | Aoji | G07D 11/0081<br>700/218 |
| 2014/0144749 | A1* | 5/2014 | Iwasaki | G07D 11/0081<br>194/206 |
| 2014/0332340 | A1* | 11/2014 | Adachi | B65H 31/24<br>194/206 |
| 2015/0100480 | A1* | 4/2015 | Colvin | G06O 20/1085<br>705/39 |
| 2016/0163144 | A1* | 6/2016 | Lee | G07D 11/006<br>271/3.15 |
| 2016/0180627 | A1* | 6/2016 | Obara | G07D 11/0066<br>700/236 |

* cited by examiner

MEDIUM PROCESSING APPARATUS WITH REJECT CASSETTE

CROSS-REFERENCE TO RELATED APPLICATION

This application claims priority to and the benefit of Korean Patent Application No. 10-2015-0190316, filed on Dec. 30, 2015, the disclosure of which is incorporated herein by reference in its entirety.

BACKGROUND

1. Field of the Invention

The present invention relates to a medium processing apparatus, and more particularly, to a medium processing apparatus capable of reducing manufacturing costs of a driving unit for carrying a medium and quickly rejecting an abnormal medium when withdrawing media.

2. Discussion of Related Art

Generally, an automated teller machine (ATM) includes a medium processing apparatus for depositing or withdrawing a medium such as paper money, checks, and the like.

A general medium processing apparatus includes a receiving and dispensing port for enabling a user to insert or receive a medium for receiving and dispensing, a discriminating unit configured to determine whether a medium inserted or withdrawn through the receiving and dispensing port is normal, a temporary storage configured to temporarily store paper money that is determined to be a normal banknote by the discriminating unit, a medium storage including a plurality of cassettes configured to store a deposited medium and eject a medium accommodated therein when there is a request for withdrawal, and a carrying path configured to connect the receiving and dispensing port, the discriminating unit, the temporary storage, and the medium storage to one another and carry a medium. The medium storage may include a plurality of recycling cassettes configured to store deposited media or media for withdrawal and a reject cassette configured to store a rejected banknote discriminated as abnormal during withdrawal.

A prior art related to the above-described medium processing apparatus with the medium storage including the plurality of recycling cassettes and the reject cassette is disclosed in Korean Patent Registration Nos. 10-1534412 and 10-1527653.

The prior patents are configured to include connected carrying paths connected to an upper module and a lower module at both sides of a medium processing apparatus to reduce a time for processing a rejected banknote during withdrawal.

However, according to such an above-described configuration, the number of connected carrying paths for connecting the upper module and the lower module is increased and manufacturing costs of the carrying paths increase and a structure of the carrying path is complicated.

Also, when a rejected banknote that may cause an obstacle to carrying is included in withdrawn media, since a means for sensing a rejected banknote and collecting and processing the rejected banknote is inadequate between the medium storage and the discriminating unit, it is difficult to quickly collect and process the rejected banknote.

SUMMARY OF THE INVENTION

The present invention provides a medium processing apparatus capable of reducing manufacturing costs of a driving unit for carrying a medium and additionally preventing an occurrence of an obstacle to a machine by quickly rejecting an abnormal medium during withdrawal.

According to an aspect of the present invention, there is provided a medium processing apparatus comprising: a receiving and dispensing port at which a medium is inserted and withdrawn; a discriminating unit configured to determine whether the medium is normal; a temporary storage in which an abnormal medium determined to be abnormal by the discriminating unit during withdrawal is temporarily stored; a reject cassette in which the abnormal medium temporarily stored in the temporary storage and a carried abnormal medium among media being withdrawn are collected and stored; a plurality of recycling cassettes configured to store media to be withdrawn; a first driving unit configured to drive a carrying path between an outlet of the discriminating unit, the receiving and dispensing port and the temporary storage; a second driving unit configured to drive a carrying path between an inlet of the discriminating unit and an inlet of the reject cassette and be a belt-roller type; and a third driving unit configured to drive a carrying path between the inlet of the reject cassette and inlets of the plurality of recycling cassettes and be a belt-guide type.

The first driving unit, the second driving unit, and the third driving unit are independently driven and controlled.

The receiving and dispensing port, the discriminating unit, the temporary storage, and the first driving unit are provided at an upper module, the reject cassette, the plurality of recycling cassettes, and the third driving unit are provided at a lower module stacked below the upper module, and the second driving unit is provided at both the upper module and the lower module.

The discriminating unit is provided at one side of the upper module and the reject cassette is provided at one side of the lower module close to the discriminating unit to minimize a length of the second driving unit.

When the discriminating unit senses the carried abnormal medium during withdrawal of media, the first driving unit remains in a driven state in a withdrawal direction and the second driving unit and the third driving unit are controlled to stop being driven.

After the driving of the second driving unit and the third driving unit is stopped, withdrawn media are collected and stored in the plurality of recycling cassettes by reversely driving of the third driving unit, and wherein when the collecting of the withdrawn media at the plurality of recycling cassettes is completed, the carried abnormal medium is collected and stored in the reject cassette by reversely driving of the second driving unit.

After the driving of the second driving unit and the third driving unit is stopped, the second driving unit and the third driving unit are reversely driven at the same time so that the withdrawn media are collected and stored in the plurality of recycling cassettes and the carried abnormal medium is collected and stored in the reject cassette.

A sensor for sensing a skewed medium is provided at the inlet of the discriminating unit.

A plurality of sensors for sensing whether media to be withdrawn are normal are provided on the carrying paths of the second driving unit and the third driving unit, and wherein the plurality of sensors sense an overly-long medium and a short-interval medium.

When the plurality of sensors sense the carried abnormal medium, the carried abnormal medium enters the second driving unit and then, due to reversely driving of the second driving unit, the carried abnormal medium is collected and stored in the reject cassette.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, a configuration and operations according to exemplary embodiments of the present invention will be described in detail as follows.

Figure 1:
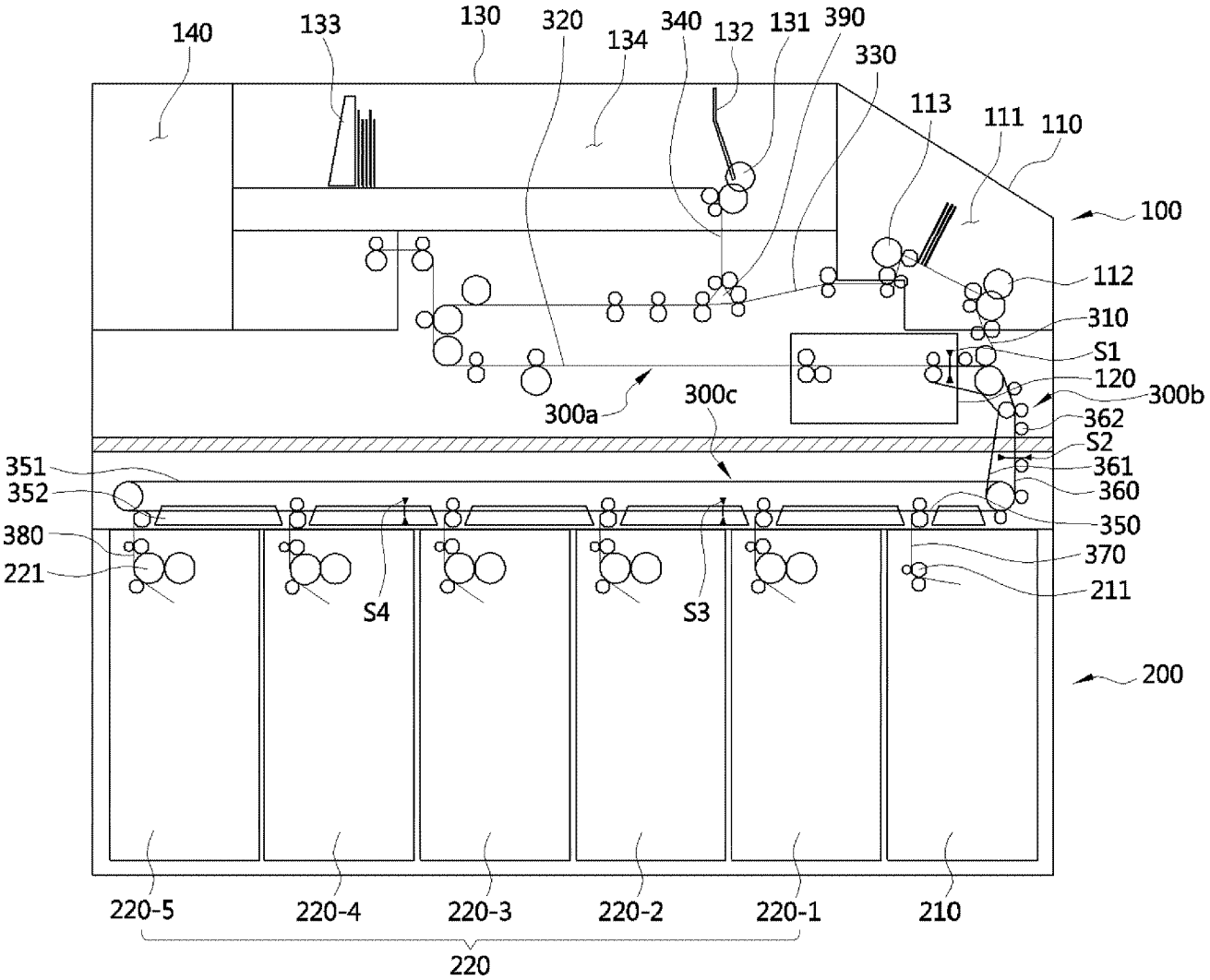
FIG. 1 is a view illustrating components of a medium processing apparatus according to embodiments of the present invention.

Referring to FIG. 1, a medium processing apparatus according to embodiments of the present invention includes a receiving and dispensing port 110 at which a medium may be inserted or withdrawn, a discriminating unit 120 configured to determine whether the medium is normal, a temporary storage 130 in which an abnormal medium determined to be abnormal by the discriminating unit during withdrawal is temporarily stored, a reject cassette 210 in which the abnormal medium temporarily stored in the temporary storage 130 and a carried abnormal medium among media being withdrawn are collected and stored, a plurality of recycling cassettes 220 configured to store media to be withdrawn, a first driving unit 300*a* configured to drive a carrying path between an outlet of the discriminating unit 120 and each of the receiving and dispensing port 110 and the temporary storage 130, a second driving unit 300*b* configured to drive a carrying path between an inlet of the discriminating unit 120 and an inlet of the reject cassette 210 and be a belt-roller type, and a third driving unit 300*c* configured to drive a carrying path between the inlet of the reject cassette 210 and inlets of the plurality of recycling cassettes 220 and be a belt-guide type.

The first driving unit 300*a*, the second driving unit 300*b*, and the third driving unit 300*c* are configured to be separately driven and controlled.

The receiving and dispensing port 110 includes a separating device 112 configured to separate deposited media inserted into an internal space 111, which is a space into which media are inserted during depositing or at which media are stacked during withdrawal, to be transferred one by one to a carrying path 310, and a stacking device 113 configured to stack the media carried through a carrying path 330 in the internal space 111. The internal space 111 may be separated into a plurality spaces by one or more dividers.

The separating device 112 and the stacking device 113 are each configured as a plurality of facing rollers, and media are separated or stacked by rotating the rollers. The separating device 112 includes a pickup roller for separating media one by one.

The discriminating unit 120 determines whether a medium transferred along the carrying paths 310 and 320 is abnormal and discriminates banknotes according to a type thereof and includes a carrying path. A driving device configured to be driven to enable media to be carried both ways is provided at the carrying path.

The discriminating unit 120 includes a sensor S1 configured to sense whether a medium is skewed, that is, tilted from a carrying direction toward one side, at the inlet thereof and a sensing means such as an image sensor, a two-sheet sensing portion, and the like therein, senses media passing along the carrying paths 310 and 320, simultaneously scans images of the media, detects whether carried media are original, types of the carried media, and whether the carried media are damaged, and transmits detected information to a controller.

The discriminating unit 120 discriminates a normal medium from an abnormal medium. Abnormal media include media that are abnormal but do not act as an obstacle to carrying media, such as a banknote type different from a preset banknote type, partially damaged or old paper money, and the like (hereinafter, abnormal media that do not act as an obstacle will be referred to as abnormal media) and media that may act as an obstacle according to a jam caused by a stacking failure when the media are stacked in the temporary storage 130, such as skewed media, overly-long media carried such that two sheets overlap, and short-interval media with a smaller interval between sequentially carried media than a preset interval (hereinafter, the media that may act as an obstacle will be referred to as carried abnormal media).

When media are withdrawn as described above, abnormal media among media determined by the discriminating unit 120 to be abnormal media are temporarily stored in the temporary storage 130, and carried abnormal media are returned and collected at the reject cassette 210.

The temporary storage 130 temporarily stores the abnormal media determined to be abnormal by the discriminating unit 120 during withdrawal and discharges the temporarily stored media into a carrying path 340 after withdrawal of normal media is completed.

A separating and stacking device 131 configured to stack and separate media is provided at an inlet of the temporary storage 130, that is, at a position close to the receiving and dispensing port 110. The separating and stacking device 131 may include a pickup roller configured to separate media stacked in an internal space 134 one by one, a feed roller configured to apply a transfer force to the media separated one by one by the pickup roller, and a guide roller installed opposite the feed roller to prevent media from being separated two sheets at a time.

The temporary storage 130 includes a front plate 132 and a rear plate 133 to enable media to be deposited in a horizontal direction while being stood in the internal space 134. The rear plate 133 is movable back and forth depending on a quantity of media stacked in the internal space 134. A free space 140 may be formed behind the temporary storage 130. In this case, capacity of the temporary storage 130 may be increased by extending the temporary storage 130 in a direction opposite a position of the receiving and dispensing port 110.

Carrying paths 310 to 380 for carrying media according to embodiments of the present invention include a first carrying path 310 configured to connect the separating device 112 of the receiving and dispensing port 110 and the inlet of the discriminating unit 120, a second carrying path 320 configured to connect the outlet of the discriminating unit 120 and a gate 390, a third carrying path 330 configured to connect the gate 390 and the stacking device 113 of the receiving and dispensing port 110, a fourth carrying path 340 configured to connect the gate 390 and the temporary storage 130, a fifth carrying path 350 configured to connect the inlet of the reject cassette 210 and the inlets of the plurality of recycling cassettes 220: 220-1, 220-2, 220-3, 220-4, and 220-5, and a sixth carrying path 360 configured to connect the inlet of the discriminating unit 120 and the inlet of the reject cassette 210. The gate 390 is provided at a point at which the second carrying path 320, the third carrying path 330, and the fourth carrying path 340 intersect with one another and changes a carrying direction of media.

Also, a connected carrying path 370 connected to the reject cassette 210 and a connected carrying path 380 connected to the recycling cassettes 220 are connected to the fifth carrying path 350.

The first driving unit 300*a* drives the second carrying path 320, the third carrying path 330, and the fourth carrying path 340. The second driving unit 300*b* drives the sixth carrying path 360. The third driving unit 300*c* functions as a driving means for driving the fifth carrying path 350.

In embodiments of the present invention, the second driving unit 300*b* is configured as a belt-roller type and the third driving unit 300*c* is configured as a belt-guide type.

Figure 2A:
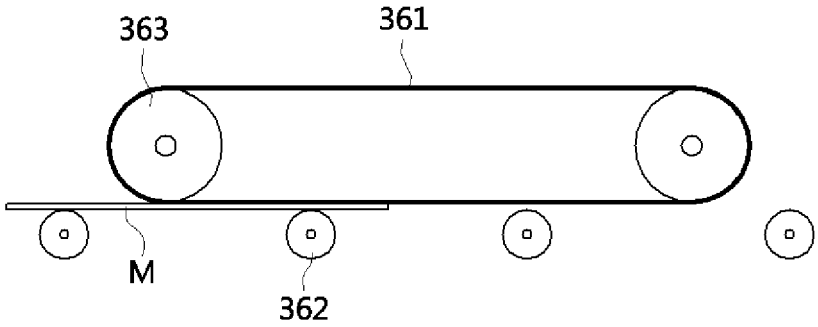
FIG. 2A is a side view of a belt-roller type carrying structure of a second driving unit.

Referring to FIG. 2A, the belt-roller type second driving unit 300*b* includes a belt 361 wound and rotated between two pulleys 363 and a roller 362 circumscribed and rotated with an outer surface of the belt 361, and is configured to hold and carry media M between the belt 361 and the roller 362. According to such an above-described belt-roller type carrying structure, media may be smoothly carried by reducing a frictional force between the media and the roller 362.

Figure 2B:
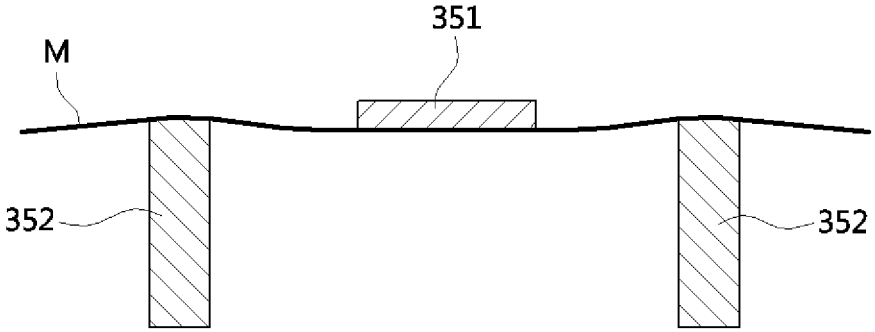
FIG. 2B is a side view of a belt-guide type carrying structure of a third driving unit.

Referring to FIG. 2B, the belt-guide type third driving unit 300*c* includes one pair of guides 352 on both sides of a belt 351, and is configured to hold and carry the media M between an outer surface of the belt 351 and top ends of the pair of guides 352. According to such an above-described belt-guide type carrying structure, a frictional force between media and the guides 352 relatively increases to prevent the media from being separated two sheets at a time and manufacturing costs of media carrying paths may be reduced by employing the guides 352 with a simple configuration in comparison to the belt-roller type carrying structure.

A plurality of sensors S2, S3, and S4 configured to sense whether withdrawn media are normal, and particularly whether overly-long media and short-interval media occur as described above, may be provided to be separated at certain intervals.

The reject cassette 210 is a space configured to collect and store media sensed as carried abnormal media among withdrawal media and includes a separating and stacking device 211 configured to separate and stack media at the inlet of the reject cassette 210.

The recycling cassettes 220 are spaces configured to store media to be withdrawn and include separating and stacking devices 221 configured to separate and stack media at the inlets of the recycling cassettes 220.

The recycling cassettes 220 may include the plurality of cassettes 220-1, 220-2, 220-3, 220-4, and 220-5 configured to store identical or different types of media. When a plurality of different banknote types of media are handled, the plurality of banknote types of media may be stored in one cassette or one banknote type of media may be stored in one cassette.

Meanwhile, the receiving and dispensing port 110, the discriminating unit 120, the temporary storage 130, and the first driving unit 300*a* may be provided at an upper module 100, and the reject cassette 210, the plurality of recycling cassettes 220, and the third driving unit 300*c* may be provided at a lower module 200 stacked below the upper module 100. Here, the second driving unit 300*b* may be provided at both the upper module 100 and the lower module 200.

Also, the discriminating unit 120 may be provided at one side of the upper module 100, and the reject cassette 210 may be provided at one side of the lower module 200 close to the discriminating unit 120 to minimize a length of the second driving unit 300*b*.

Since the length of the second driving unit 300*b* is configured as above to be short, media sensed as carried abnormal media among withdrawn media may be quickly collected at the reject cassette 210.

Hereinafter, referring to FIGS. 3 to 8, a process of withdrawing media from the media processing apparatus according to embodiments of the present invention will be described.

Figure 3:
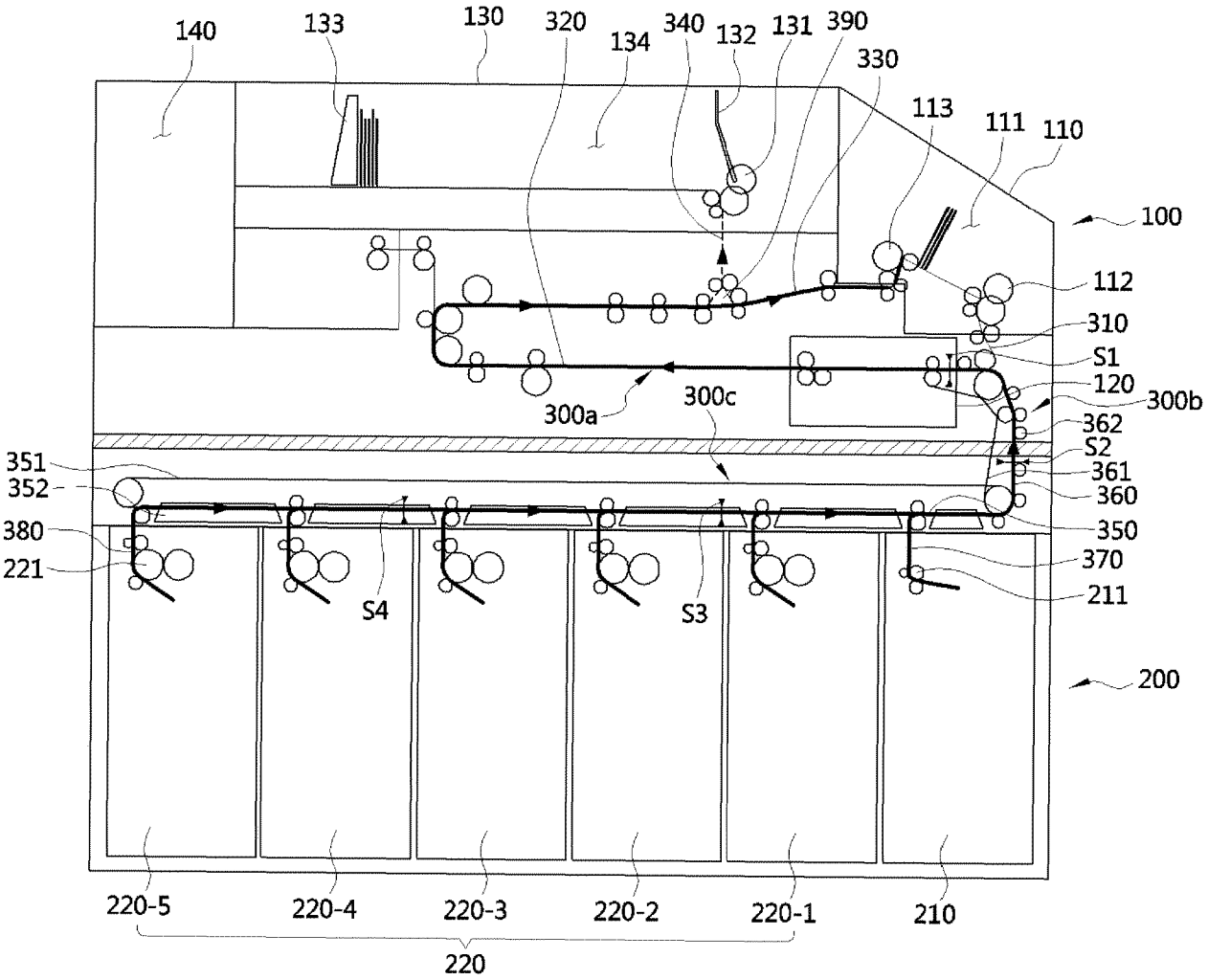
FIG. 3 is a view illustrating carrying paths for a normal medium and an abnormal medium during withdrawal in a medium processing apparatus according to embodiments of the present invention.

Referring to FIG. 3, when media are being withdrawn, media stored in the recycling cassettes 220 are separated one by one by the separating and stacking device 211 and transferred to the discriminating unit 120 by the third driving unit 300*c* and the second driving unit 300*b* being driven along the fifth carrying path 350 and the sixth carrying path 360.

Media determined by the discriminating unit 120 to be normal are carried to the receiving and dispensing port 110 by the first driving unit 300*a* being driven along the second carrying path 320 and the third carrying path 330. Media determined by the discriminating unit 120 to be abnormal media among abnormal media are carried along the second carrying path 320 and then, due to directionally switching the gate 390, carried to the temporary storage 130 along the fourth carrying path 340 as is shown by a dotted line in FIG. 3.

Figure 4:
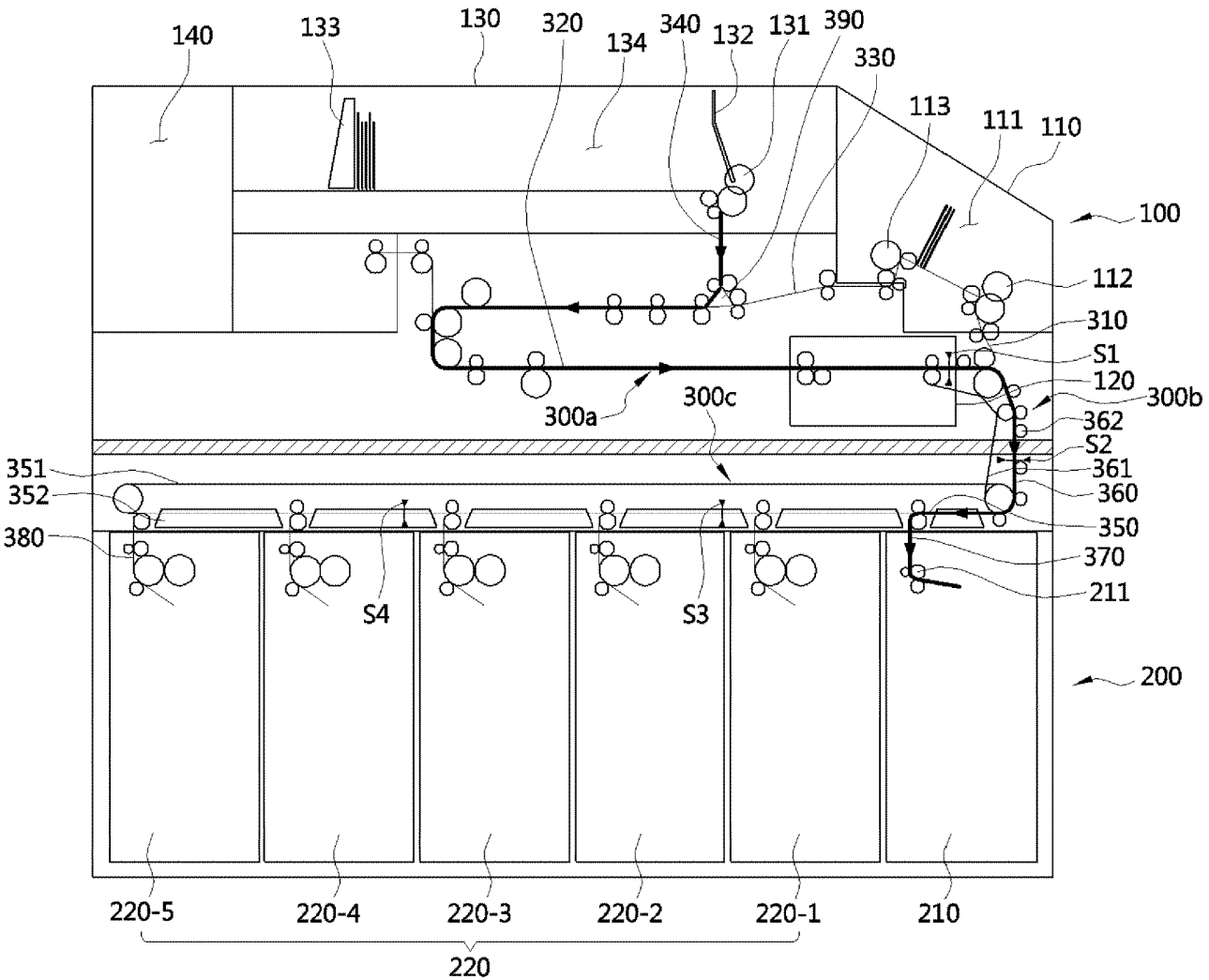
FIG. 4 is a view illustrating a carrying path in which an abnormal medium temporarily stored in a temporary storage is collected at a reject cassette during withdrawal in the medium processing apparatus according to embodiments of the present invention.

After withdrawal of normal media is completed as shown in FIG. 4, the abnormal media temporarily stored in the temporary storage 130 are separated from the temporary storage 130 and carried to and collected at the reject cassette 210 along the fourth carrying path 340, the gate 390, the second carrying path 320, the discriminating unit 120, the sixth carrying path 360, and the connected carrying path 370.

Figure 5:
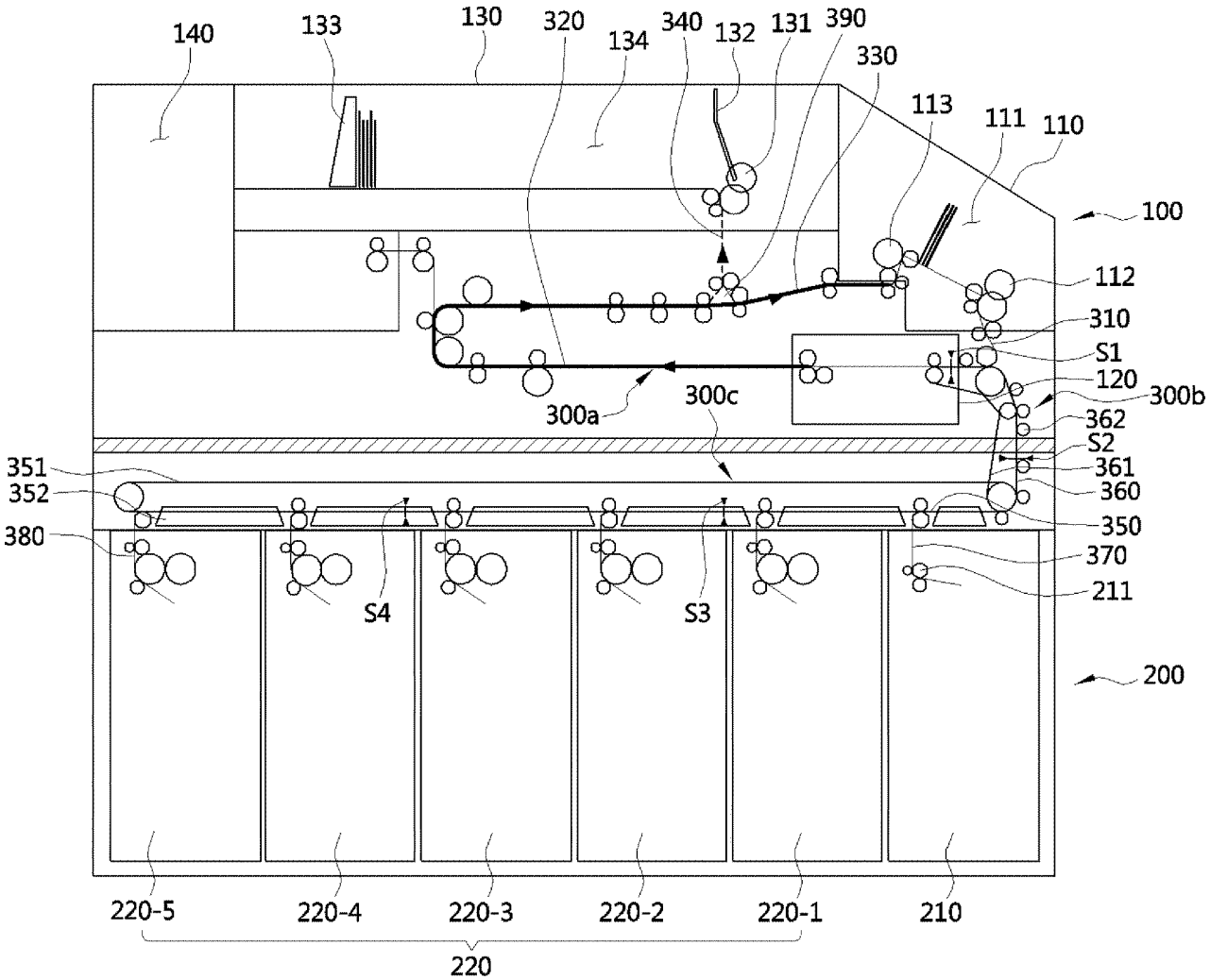
FIG. 5 is a view illustrating a state in which a first driving unit is driven and driving of the second driving unit and the third driving unit is stopped when a carried abnormal medium is sensed during withdrawal in the medium processing apparatus according to embodiments of the present invention.

Referring to FIG. 5, when media determined by the discriminating unit 120 to be carried abnormal media occur while media are being withdrawn, the first driving unit 300*a* is controlled to remain in a driven state in a withdrawal direction, and the second driving unit 300*b* and the third driving unit 300*c* are controlled to stop being driven.

Accordingly, normal media or abnormal media being carried in front of the outlet of the discriminating unit 120 are carried toward the receiving and dispensing port 110 or the temporary storage 130 by the first driving unit 300*a* being driven, and carried abnormal media inside the discriminating unit 120 and withdrawn media being carried behind the outlet of the discriminating unit 120 remain in a state in which the carrying thereof is stopped.

Hereinafter, an example in which carried abnormal media are rejected after driving of the second driving unit 300*b* and the third driving unit 300*c* is stopped will be described.

Figure 6:
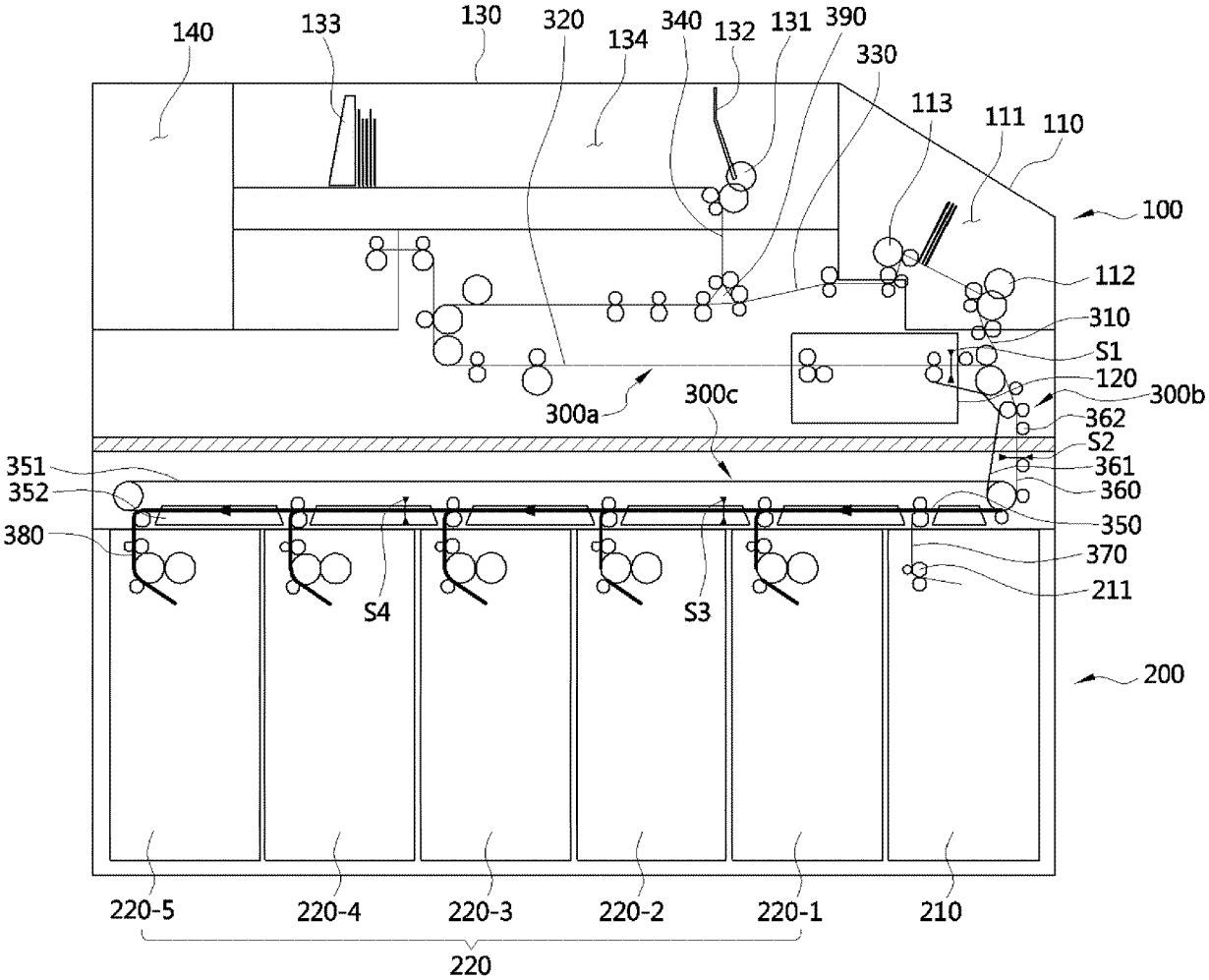
FIG. 6 is a view illustrating a state in which withdrawn media are collected at a recycling cassette by reversely driving of the third driving unit when a carried abnormal medium is sensed during withdrawal in the medium processing apparatus according to embodiments of the present invention.

As an example, first, as shown in FIG. 6, withdrawn media are collected and stored in the recycling cassettes 220 through the fifth carrying path 350 by reversely driving of the third driving unit 300*c*.

Figure 7:
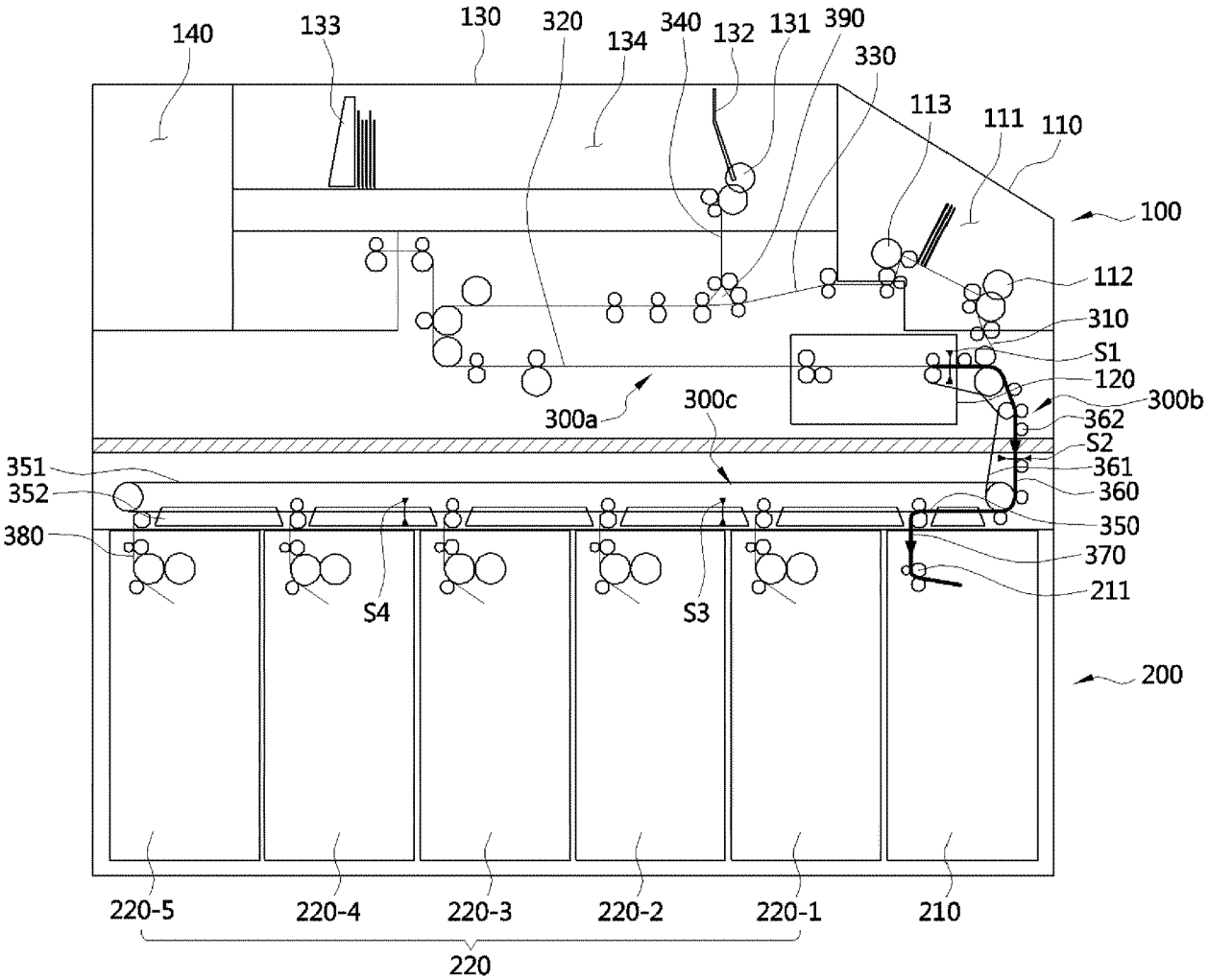
FIG. 7 is a view illustrating a state in which, a carried abnormal medium is collected at the reject cassette by reversely driving of the third driving unit when the carried abnormal medium is sensed during withdrawal in the medium processing apparatus according to embodiments of the present invention.

When the collecting of the withdrawn media at the recycling cassettes 220 is completed, as shown in FIG. 7, carried abnormal media are collected and stored in the reject cassette 210 through the sixth carrying path 360 by reversely driving of the second driving unit 300*b*.

Figure 8:
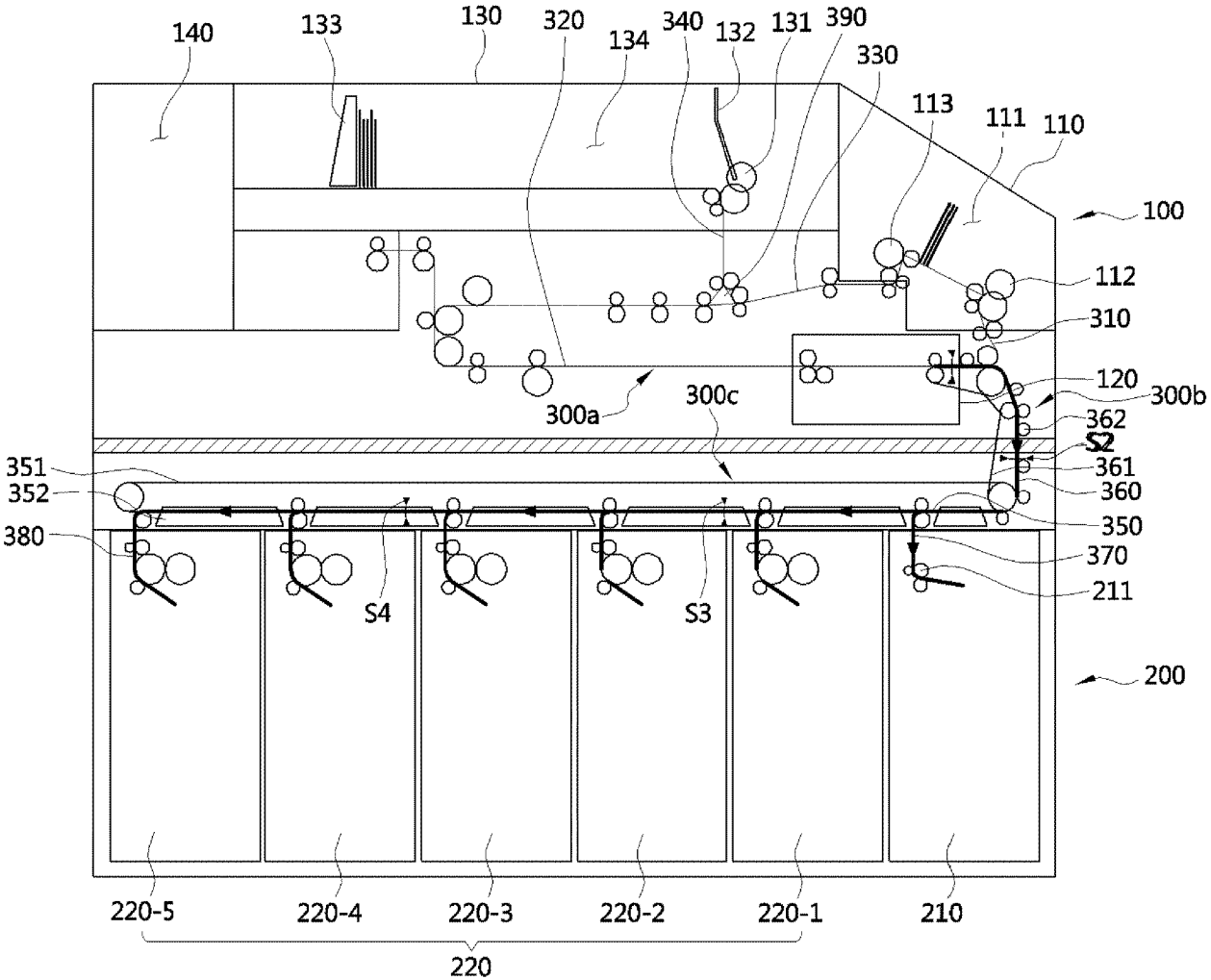
FIG. 8 is a view illustrating a state in which withdrawn media are collected at the recycling cassette and a carried abnormal medium is collected at the reject cassette by the second driving unit and the third driving unit being reversely driven at the same time when the carried abnormal medium is sensed during withdrawal in the medium processing apparatus according to embodiments of the present invention.

As another example, the second driving unit 300*b* and the third driving unit 300*c* are reversely driven at the same time after driving of the second driving unit 300*b* and the third driving unit 300*c* is stopped as shown in FIG. 8 so that withdrawn media positioned at the fifth carrying path 350 are collected and stored in the recycling cassettes 220 and carried abnormal media at the discriminating unit 120 are collected and stored in the reject cassette 210.

Meanwhile, when media are withdrawn, the plurality of sensors S2, S4, and S5 provided on the carrying paths of the second driving unit 300*b* and the third driving unit 300*c* sense whether overly-long media and short-interval media are present. When the carried abnormal media such as the overly-long media and the short-interval media among the withdrawn media is sensed, the carried abnormal media enter the second driving unit 300*b*, and then the carried abnormal media are controlled to be collected and stored in the reject cassette 210 by reversely driving of the second driving unit 300*b*.

In this case, since it is possible to return the carried abnormal media before the carried abnormal media are carried to the discriminating unit 120, a rejecting time may be reduced.

According to embodiments of the present invention, a medium processing apparatus may include a roller-guide type third driving unit provided above a plurality of recycling cassettes to reduce manufacturing costs of a driving unit for carrying a medium.

Also, when a retuned abnormal medium is sensed during withdrawal of media, since a first driving unit, a second driving unit, and a third driving unit are separately driven, the first driving unit remains in a driven state in a withdrawal direction and the second driving unit and the third driving unit are reversely driven to quickly reject a carried abnormal medium to prevent an obstacle to a machine caused by carrying the carried abnormal medium from occurring.

Also, since a reject cassette is disposed closer to a discriminating unit, a length of the second driving unit is minimized so that a time for rejecting a carried abnormal medium is reduced.

Also, when a plurality of sensors provided at the second driving unit and the third driving unit sense a carried abnormal medium, the carried abnormal medium enters the second driving unit and then is immediately reversely driven before reaching the discriminating unit so that a rejecting process is more quickly performed.

It should be apparent to those skilled in the art that various modifications can be made to the above-described exemplary embodiments of the present invention without departing from the spirit or scope of the invention. Thus, the present invention is intended to cover all such modifications provided they come within the scope of the appended claims and their equivalents.

What is claimed is:

1. A medium processing apparatus with reject cassette comprising:

a receiving and dispensing port at which a medium is inserted and withdrawn;

a discriminating unit configured to determine whether the medium is normal;

a temporary storage in which an abnormal medium determined to be abnormal by the discriminating unit during withdrawal is temporarily stored;

a reject cassette in which the abnormal medium temporarily stored in the temporary storage and a carried abnormal medium among media being withdrawn are collected and store;

a plurality of recycling cassettes configured to store media to be withdrawn;

a first driving unit configured to drive a carrying path between an outlet of the discriminating unit, the receiving and dispensing port and the temporary storage;

a second driving unit configured to drive a carrying path between an inlet of the discriminating unit and an inlet of the reject cassette and including a belt and a roller; and a third driving unit configured to drive a carrying path between the inlet of the reject cassette and inlets of the plurality of recycling cassettes and including a belt and a guide;

wherein when the discriminating unit senses the carried abnormal medium during withdrawal of media, the first driving unit remains in a driven state in a withdrawal direction and the second driving unit and the third driving unit are controlled to stop being driven.

2. The medium processing apparatus with reject cassette of claim 1, wherein the first driving unit, the second driving unit, and the third driving unit are independently driven and controlled.

3. The medium processing apparatus with reject cassette of claim 1, wherein the receiving and dispensing port, the discriminating unit, the temporary storage, and the first driving unit are provided at an upper module, the reject cassette, the plurality of recycling cassettes, and the third driving unit are provided at a lower module stacked below the upper module, and the second driving unit is provided at both the upper module and the lower module.

4. The medium processing apparatus with reject cassette of claim 3, wherein the discriminating unit is provided at one side of the upper module and the reject cassette is provided at one side of the lower module close to the discriminating unit to minimize a length of the second driving unit.

5. The medium processing apparatus with reject cassette of claim 1, wherein after the driving of the second driving unit and the third driving unit is stopped, withdrawn media are collected and stored in the plurality of recycling cassettes by reversely driving of the third driving unit, and wherein when the collecting of the withdrawn media at the plurality of recycling cassettes is completed, the carried abnormal medium is collected and stored in the reject cassette by reversely driving of the second driving unit.

6. The medium processing apparatus with reject cassette of claim 1, wherein after the driving of the second driving unit and the third driving unit is stopped, the second driving unit and the third driving unit are reversely driven at the same time so that the withdrawn media are collected and stored in the plurality of recycling cassettes and the carried abnormal medium is collected and stored in the reject cassette.

7. The medium processing apparatus with reject cassette of claim 1, wherein a sensor for sensing a skewed medium is provided at the inlet of the discriminating unit.

8. A medium processing apparatus with reject cassette comprising:

a receiving and dispensing port at which a medium is inserted and withdrawn;

a discriminating unit configured to determine whether the medium is normal;

a temporary storage in which an abnormal medium determined to be abnormal by the discriminating unit during withdrawal is temporarily stored;

a reject cassette in which the abnormal medium temporarily stored in the temporary storage and a carried abnormal medium among media being withdrawn are collected and stored;

a plurality of recycling cassettes configured to store media to be withdrawn;

a first driving unit configured to drive a carrying path between an outlet of the discriminating unit, the receiving and dispensing port and the temporary storage;

a second driving unit configured to drive a carrying path between an inlet of the discriminating unit and an inlet of the reject cassette and consisting of belt and roller; and a third driving unit configured to drive a carrying path between the inlet of the reject cassette and inlets of the plurality of recycling cassettes and consisting of belt and guide;

wherein a plurality of sensors for sensing whether media to be withdrawn are normal are provided on the carrying paths of the second driving unit and the third driving unit, wherein the plurality of sensors sense an overly-long medium and a short-interval medium, and wherein when the plurality of sensors sense the carried abnormal medium, the carried abnormal medium enters the second driving unit and then, due to reversely driving of the second driving unit, the carried abnormal medium is collected and stored in the reject cassette.

* * * * *